United States Patent [19]

Hoppe

[11] Patent Number: 4,600,506

[45] Date of Patent: Jul. 15, 1986

[54] SCREENING MACHINE AND METHOD

[75] Inventor: Kurt Hoppe, Hilden, Fed. Rep. of Germany

[73] Assignee: Hein, Lehmann AG, Dusseldorf, Fed. Rep. of Germany

[21] Appl. No.: 729,085

[22] Filed: May 2, 1985

Related U.S. Application Data

[63] Continuation of Ser. No. 497,610, May 24, 1983, abandoned.

[30] Foreign Application Priority Data

Jun. 5, 1982 [DE] Fed. Rep. of Germany ..... 3221344

[51] Int. Cl.[4] ..... B07B 1/28

[52] U.S. Cl. ..... 209/310; 209/325

[58] Field of Search ..... 209/325, 326, 366.5, 209/310

[56] References Cited

U.S. PATENT DOCUMENTS

| | | | |
|---|---|---|---|
| 3,633,745 | 1/1972 | Wehner | 209/325 X |
| 3,762,547 | 10/1973 | Stirk | 209/326 |
| 4,224,146 | 9/1980 | Kent et al. | 209/325 X |

*Primary Examiner*—Charles Hart

*Attorney, Agent, or Firm*—Karl F. Ross; Herbert Dubno

[57] ABSTRACT

The invention relates to a screening machine having a multiplicity of mutually parallel transverse supports which are arranged transversely to the transport direction of the material being screened and on or between which a flexible screen plate is fastened. The transverse supports, which are movable relative to one another, of at least two movement systems are driven in such a way that mutually adjacent transverse supports alternately approach one another and move away from one another. The transverse supports move in separate, mutually parallel planes which are at an angle to the planes in which the transverse supports of one particular movement system are located.

9 Claims, 3 Drawing Figures

SCREENING MACHINE AND METHOD

This is a continuation of co-pending application Ser. No. 497,610 filed on May 24, 1983 and now abandoned.

FIELD OF THE INVENTION

The invention relates to a screening machine and method having a multiplicity of mutually parallel transverse supports which are arranged transversely to the transport direction of the material being screened and on or between which a flexible screen plate is fastened, the transverse supports, which are movable relative to one another, of at least two movement systems being driven in which mutually adjacent transverse supports alternately approach one another and move away from one another.

BACKGROUND OF THE INVENTION

Screening machines of this type, operating in accordance with the principle of tension shafts, are known (German Patent Specification No. 2,425,953). In these known screening machines, the transverse supports of both movement systems are each fastened between two side plates, both of which are moved by an eccentric drive in their longitudinal direction, in such a way that the movement planes of all the supports are parallel to the longitudinal direction of the side plates and hence to the conveying direction of the material to be screened. This movement of the transverse supports within the plane, in which they are located, results in a movement of the material being screened transversely to the plane of the screen only to the extent to which the screen plate acts on the material being screened by alternating flexing and tensioning. Controlled acceleration or braking of the material being screened is not possible. Rather, the material being screened is conveyed solely in accordance with the inclination of the screening machine.

OBJECTS OF THE INVENTION

It is an object of the invention to improved screening machine and method of the type described in which an acceleration or reduction in the transport speed of the material to be screened can be effected independently of the inclination of the screening machine or screening plane.

Futhermore, it is an object of the invention to provide a screening machine of the type described, on which, above the screen, a second screen can be fastened which can be driven directly by one of the two movement systems without additional structural measures and which not only protects the first screen but can also effect classifying work.

SUMMARY OF THE INVENTION

According to the invention, these objects are achieved by constraining the transverse supports to move in separate, mutually parallel planes which are at an angle to the planes in which the transverse supports of one particular movement systems are located.

In such a screening machine and method, the transverse supports in mutually adjacent positions no longer move on the shortest path directly towards one another and away from one another, but move mutually parallel in inclined planes and additionally assume a position of closest approach and a position of greatest distance, the screen sagging in an arch in the first position and being tautly tensioned in the second position. In an intermediate middle position, all the transverse supports lie in a single plane parallel to the screening machine.

These obliquely running movements of the transverse supports generate an acceleration of the material being screened in this oblique direction, so that the material being screened is conveyed even if the screening machine is in a horizontal position, and is subjected to an additional acceleration if the screening machine is in an inclined position. However, this acceleration of the material being screened, generated by the movement of the mat, can also be utilized in the direction opposite to that of transport, so that the transport speed of the material being screened is reduced and the material hence remains on the screen for a longer period and is screened out more intensively. Coupled with very simple construction, better cleaning of the screen plate is also achieved.

According to a feature of the invention, the movement planes of the transverse supports form angles of 10° to 80°, in particular 30° to 60°, with the planes of the support positions.

It is a particular advantage if a second screen is fastened, above the first screen plate, to one of the movement systems. The second screen does not require any additional actuating devices, but is moved by the obliquely extending shaking movement of one of the two systems in such a way that the material to be screened is lifted up from the screen plate and hence the second screen not only shields and protects the first screen but also has itself a classifying action. Moreover, due to this movement, the second screen can be self-cleaning and therefore can also have small and more precise screen openings.

According to a preferred embodiment, the transverse supports of each movement system are in each case fastened between two side plates or in a frame. The second screen can also be fastened to one of the side plates or to the frame.

Reliable and structurally simple actuation, free from harmful vibrations, is obtained when at least one of the movement systems, in particular the side plates or the frame thereof, is driven via at least one connecting rod, the direction of force of which runs through the center of gravity of the movement system. This also makes it possible that the forces of gravity are completely taken up by the connecting rod. An additional spring element between the actuated movement system and the drive is not necessary.

BRIEF DESCRIPTION OF THE DRAWING

An illustrative embodiment of the invention is represented, in part diagrammatically, in the drawing and is described in more detail below. In the drawing.

SPECIFIC DESCRIPTION

Figure 1:
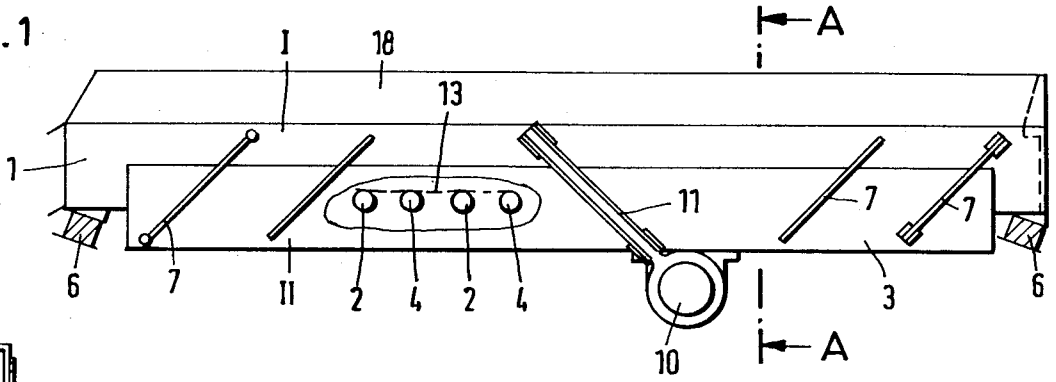
FIG. 1 shows a side view of the screening machine.
Figure 2:
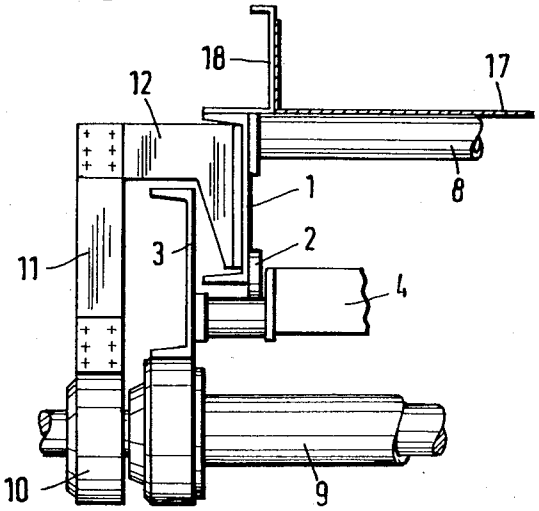
FIG. 2 shows part of a section along line A—A in FIG. 1.

The first inner movement system I has two side plates 1 of U-shaped profile, between which transverse supports 2 are fastened, mutually parallel and at regular spacing. Outside the side plates 1, there are side plates 3 parallel to the inner side plates 1, and these carry transverse supports 4 which are arranged centrally between the transverse supports 2 at the same height. Thus, the transverse supports 2,4 alternate and, on their top side, they carry a screen plate 13 which is linearly fixed to the transverse supports.

While the side plates 1 are mounted on the foundation via spring elements 6, the side plates 3 are fastened to the particular adjacent side plate 1 via pairs 7 of guide springs or via rods which are articulated at both ends. For this purpose, tubular carriers 8 serving as a mounting for the springs 7 can project from the outside of the side plate 1. The rods or springs 7 are arranged at an angle, in particular at an angle of 45°, to the screen plane or to the planes in which the transverse supports lie.

A drive shaft 9 with an eccentric 10 is fixed to the outer system II and hence to the side plates 3, the eccentric 10 actuating a connecting rod 11, of which the end remote from the eccentric is fixed via a projecting arm 12 to the side plate 1 and hence to the inner movement system I. The connecting rod 11 consisting of one or more leaf springs extends at an angle, in particular at an angle of 45°, to the plane of the screen plate 13 or to the planes 14, 14', 14" in which the respective transverse supports are located. At the same time, the connecting rod 11 is at right angles to the rods or springs 7.

Figure 3:
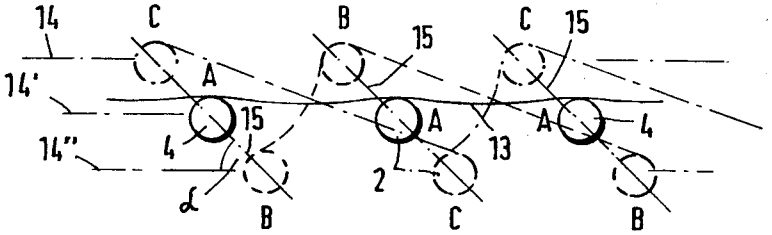
FIG. 3 shows an illustration of the movement of the transverse supports with the screen plate fastened thereto.

A relative movement of the systems I, II by means of the eccentric 10 and the connecting rod 11 leads to a movement of the transverse supports 2, 4 in planes 15 which are parallel to the connecting rod 11. Thus, the transverse supports alternately take up the positions A, B and C shown in FIG. 3, so that the screen plate 13 is alternately compressed and stretched.

A screen 17 located between two side plates 18 is fixed, in particular as a shielding cover, to one or both of the systems, that is to say the side plate 1 in the illustrative embodiment. The side plates 18 are fastened directly to the top of the side plates 1 and follow the movements of the side plate 1. In contrast to the screen plate 13, the plate of the screen 17 is not alternately compressed and stretched but only vibrated in an oblique direction, corresponding to the movement of the system I.

I claim:

1. A screening machine comprising:

a first support having a pair of opposite longitudinal members bridged by a plurality of mutually spaced-apart first transverse members lying in a common first plane;

a second support having a pair of opposite longitudinal members bridged by mutually parallel spaced-apart second transverse members lying in a common second plane and alternating with said first transverse members;

oscillating means connected to said supports and including a connecting rod oriented so that the force generated thereby on one of said supports runs through the center of gravity of a movement system formed by one of said supports for displacing same and effecting relative movement of said transverse members of said supports and of said first and second planes, so that the transverse members of the two supports move toward and away from one another while being confined exclusively to linear movement in separate planes of the respective transverse members which are inclined at a given angle to said first and second planes in which the transverse members of each support lie; and a flexible screen carried by said transverse members of both of said supports whereby said screen sags between each first and a respective second transverse member as the respective first and second transverse members of said supports approach one another and is drawn taut between respective first and second transverse members as said supports move apart.

2. The screening machine defined in claim 1 wherein said planes of movement of said transverse members from angles of 10° to 80° with the planes in which the transverse members of each support lie.

3. The screening machine defined in claim 2 wherein the movement planes of the transverse members form angles of 30° to 60° with the planes in which the transverse members of each support lie.

4. The screening machine defined in claim 1, further comprising a second screen fastened to one of said supports above the first mentioned screen.

5. The screening machine defined in claim 1 wherein each of said supports forms a frame.

6. The screening machine defined in claim 5, further comprising a second screen carried by the frame formed by one of said supports above the first mentioned screen.

7. A method of operating a screening machine having a first support in which a pair of opposite longitudinal members are bridged by a plurality of mutually spaced-apart first transverse members lying in a common first plane, a second support in which a pair of opposite longitudinal members are bridged by mutually spaced-apart second transverse members lying in a common second plane and alternating with said first transverse members, oscillating means connected to said first and second supports and including a connecting rod oriented so that the force generated thereby on one of said supports runs through the center of gravity of a movement system formed by one of said supports, and a flexible screen carried by said first and second transverse members, comprising the steps of:

(a) linearly displacing in a first direction parallel to said connecting rod said first and second supports and thereby effecting relative movement of said first and second transverse members and said first and second planes from a coincidental median position and inclined to said planes, whereby said first and second transverse members move toward one another in linear paths in mutually parallel separate planes of the respective transverse members inclined to said first and second planes to a first limit position in which the respective first and second transverse members are minimally spaced-apart from one another;

(b) displacing in a second direction said first and second supports and effecting relative movement of said first and second transverse members and said first and second planes from said first limit position, whereby said first and second transverse members move away from one another in linear paths in said separate planes of the respective transverse members to said median position;

(c) further displacing as in step (b) in said second direction, said first and second transverse members from said median position to a second limit position in which the respective first and second transverse members are maximally spaced-apart from one another;

(d) further displacing as in step (a) in said first direction, said first and second transverse members from said second limit position to said median position; and (e) repeating steps (a), (b), (c) and (d) whereby said flexible screen sags between each first and a respective second transverse member as the respective first and second transverse members of said supports approach one another and is drawn taut between respective first and second transverse members as said supports move apart.

8. The method defined in claim 7 wherein said mutually parallel planes are inclined to said first and second planes at angles of 10° to 80°.

9. The method defined in claim 8 wherein said mutually parallel planes are inclined to said first and second planes at angles of 30° to 60°.

* * * * *